United States Patent [19]

Noack

[11] 4,377,119

[45] Mar. 22, 1983

[54] METHOD FOR BURNING MATERIALS HAVING COMPONENTS THAT ARE DIFFICULT TO BURN OUT, AND APPARATUS FOR CARRYING OUT THE SAME

[75] Inventor: Rolf Noack, Oberhausen, Fed. Rep. of Germany

[73] Assignee: Deutsche Babcock Aktiengesellschaft, Oberhausen, Fed. Rep. of Germany

[21] Appl. No.: 195,114

[22] Filed: Oct. 8, 1980

[30] Foreign Application Priority Data

Jan. 30, 1980 [DE] Fed. Rep. of Germany ..... 3003245

[51] Int. Cl.[3] ..... F23G 5/00

[52] U.S. Cl. ..... 110/346; 110/245; 122/4 D

[58] Field of Search ..... 110/245, 346; 122/4 D

[56] References Cited

U.S. PATENT DOCUMENTS 3,212,553 10/1965 Cathala ..... 431/10 X
3,605,655 9/1971 Warshawsky et al. ..... 110/245 X
3,907,674 9/1975 Roberts et al. ..... 110/245 X
4,036,153 7/1977 Nauta ..... 110/245
4,168,670 9/1979 Wall et al. ..... 110/245 X
4,270,468 6/1981 Robinson et al. ..... 110/245

FOREIGN PATENT DOCUMENTS 1522601 8/1978 United Kingdom ..... 110/245

*Primary Examiner*—Edward G. Favors
*Attorney, Agent, or Firm*—Max Fogiel

[57] ABSTRACT

An arrangement for the burning of materials having components that are difficult to burn out and which tend to be adhesive upon heating. A turbulent layer is formed and connected with a combustion chamber for burning the materials. Combustion air is distributed to the turbulent layer and the combustion chamber for removing a portion of heat that is released, so that the combustion chamber retains a minimum temperature above a predetermined level. A contact chamber is connected to the turbulent layer and communicates with the combustion chamber. A constricting collar is provided with nozzles for applying combustion air.

7 Claims, 1 Drawing Figure

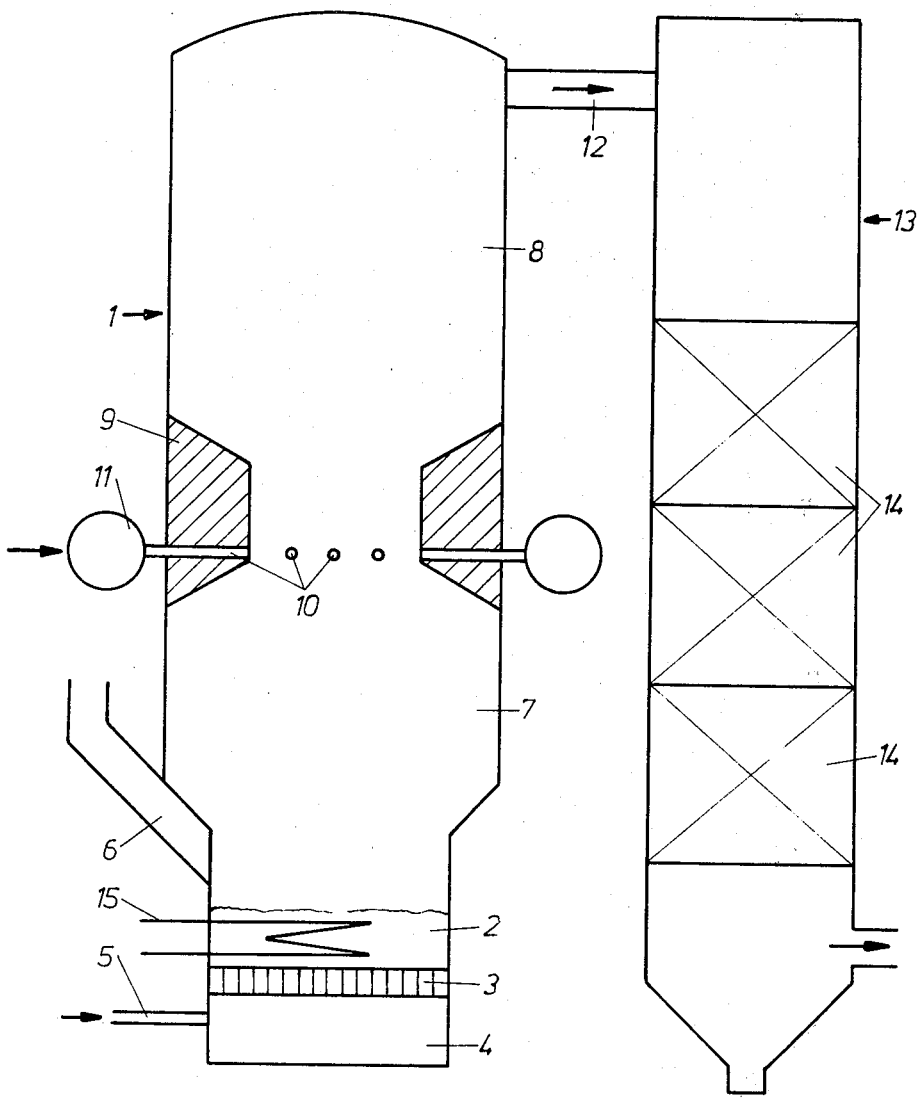
12
13
8
1
9
11
14
10
7
14
6
15
2
5
3
4

METHOD FOR BURNING MATERIALS HAVING COMPONENTS THAT ARE DIFFICULT TO BURN OUT, AND APPARATUS FOR CARRYING OUT THE SAME

BACKGROUND OF THE INVENTION

The present invention relates to a method and associated apparatus for burning materials which contain components that are difficult to burn out. Included in these materials, may also be components which have a high content of volatile elements. Upon heating of these materials in a turbulent layer, they tend to become adhesive.

Materials which exhibit the aforementioned properties either individually or in combination, are, for example, certain plastic or synthetic materials which provide difficulties in burning, in view of these properties. When burning materials having a high portion of volatile components, unburned particles are produced out of the turbulent layer. As a result, the heat which is released due to the combustion or burning, cannot be completely received or accepted by the turbulent layer. Under these conditions, it is known to provide for after-burning of the unburned components, by applying additional air above the turbulent layer.

Through burning or partial combustion in a turbulent bed of granulated inert material, very high efficiencies are achieved in relation to the volume amount, which are to be fed back to the turbulent layer with high temperature and material transition. Combustion of a turbulent layer can be carried out, according to the properties of the ash and inert materials, only at relatively low temperatures of substantially 700° to 800° C., so that it is not adapted for the burning of materials which contain components that are difficult to burn out. Such materials can be considered in the form of , for example, plastics or synthetic materials, from which soot or predetermined hydrocarbons result upon combustion. These are burned out completely only at high temperatures and sufficient process time at these temperatures.

Accordingly, it is an object of the present invention to provide a method and associated apparatus to burn out of materials completely those components which are difficult to burn out and/or components which have a high content of volatile elements, and/or materials which upon heating become adhesive. The process is to be carried out under special requirements and temperature and process time conditions for the complete burning out of such components.

It is another object of the present invention to provide an arrangement of the foregoing character which is simple in construction and may be economically fabricated.

A further object of the present invention is to provide an arrangement, as described, which may be easily maintained in service and has a substantially long operating life.

SUMMARY OF THE INVENTION

The objects of the present invention are achieved by providing that the combustion is carried out in the turbulent layer and a combustion chamber connected after the turbulent layer in flow direction. The combustion air required for this purpose, is distributed to the turbulent layer and combustion chamber. A portion of the free or released heat is removed, so that a predetermined minimum temperature is maintained in the combustion chamber. The heat of the turbulent layer is preferably thereby removed.

This method is adapted to burn all of the components for which a predetermined minimum temperature is required for their complete conversion. This temperature is set in the combustion chamber, in which the required combustion air is added. The magnitude of this mass is calculated on the basis of a stepped heat balance from the gross amount or aggregate and the heat values or thermal coefficients of the materials to be burned. The remaining part of the combustion air is applied to the turbulent layer. If the turbulent layer becomes too hot thereby, heat is removed through cooling surfaces. The magnitude of the amount of heat to be taken from the turbulent layer, and thereby the magnitude of the cooling surfaces, is dependent on the fuel composition and the portion of combustion air which is introduced into the turbulent layer as primary air. The method, in accordance with the present invention, thereby is particularly well adapted for the combustion of plastics or synthetic materials which tend to become adhesive upon being heated. These become surrounded by inert material in the turbulent layer, so that the material particles do not adhere to one another or become lumped.

To carry out the method of the present invention, there is provided apparatus in which the turbulent layer is constructed of sand, and to which a contact chamber or communicating chamber is connected. The latter is directly connected to a combustion chamber. A constriction or collar arrangement is provided between the combustion chamber and the contact chamber, and has nozzles for introducing the combustion air. The constricting collar arrangement fulfills two objects. First, it serves as a mixing path for the gas leaving the turbulent layer and the second combustion air. As a result of the acceleration of the gases, thereby, relative velocities are produced between the gas and prevailing soot particles, and this improves the combustion. The constriction has accordingly in this case, the function of being a burner.

The constriction or collar arrangement has the extended object of coupling the thermal or heat radiation out of the combustion chamber into the contact or communicating chamber. With this construction, the minimum temperature that is required together with sufficient processing time are to be maintained, as they are required for complete burning or combustion of the soot and the other components in the combustion chamber which are difficult to burn out. The turbulent layer has thereby the advantages, that large efficiencies are achieved with a small combustion unit.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

A schematic sectional longitudinal view through the arrangement, in accordance with the present invention.

DESCRIPTION OF THE PREFERRED EMBODIMENTS

The apparatus in accordance with the present invention, has a reactor 1 which may serve for the burning of, for example, plastic or synthetic scrap material. These are inclined to form soot upon being burned, or they may contain other components which can be burned out completely only at high temperature and sufficiently allowed processing time. The reactor 1 can also be used for the burning or combustion of materials having a high content of volatile components, as well as materials which tend to become adhesive upon being heated.

The reactor 1 has in its lower portion, a turbulent layer 2 which is maintained above an on-flow base 3. An air chamber 4 is provided beneath this on-flow base 3, and primary combustion air is applied to this air chamber 4 through a line 5. The plastic or synthetic scrap materials are fed into the turbulent layer 2, through a sidewise located shaft 6.

Due to the conversion of the plastic or synthetic scrap materials with the combustion air that is blown in, a smoldering or partial burning results in the turbulent layer 2. The gases containing the soot particles and other components which are difficult to burn out, exit from the turbulent layer 2 at a temperature of substantially 650° C. These gases then reach the contact or communicating chamber 7 which is provided above the turbulent layer 2 within the reactor 1. This contact chamber 7 has a larger cross-section than the turbulent layer 2. The contact chamber 7 serves the purpose to avoid largely the taking along of solid particles by the gases out of the turbulent layer 2.

The reactor 1 has a combustion chamber 8 above the contact chamber 7. In this combustion chamber 8, the gases leaving the turbulent layer are completely burned. A constriction or collar arrangement 9 is provided between the contact chamber 7 and the combustion chamber 8 within the reactor 1. Nozzles 10 are introduced through the constriction or collar arrangement 9, and secondary combustion air is provided to these nozzles 10 through a ring-shaped line 11 surrounding the reactor 1.

The combustion chamber 8 is connected to a waste heat boiler 13 through a fire-tight pipeline 12. The waste heat boiler 13 is constructed in the form of a flue gas drawing unit, and has a number of heat exchangers 14 which are schematically represented in the drawing. After giving off their heat, the cooled gases leave the waste heat boiler 13 out of its lower part.

In the turbulent layer, there are provided cooling surfaces. These cooling surfaces can be constructed in the form of pipe bundles 15 which may be withdrawn. In this manner, the size of the cooling surfaces may be fitted to the heat supply or heat content of the turbulent layer 2.

The combustion chamber 8 is constructed in a fire-tight manner. When required, the combustion chamber 8 can also be surrounded with cooling pipes. With such an arrangement, the cooling surfaces in the turbulent layer 2 can be omitted.

A portion of combustion air is introduced into the combustion chamber 8, through the nozzles 10, so that a minimum temperature is established, which is sufficient for the combustion of components that are difficult to burn out and are contained in the gases leaving the turbulent layer 2. The remaining portion of the stoichiometric combustion air is blow into the turbulent layer 2 through the on-flow base 3. A part of the heat of the turbulent layer 2 is removed by the circulated cooling medium through the pipe bundle 15. The heat quantity removal is dependent on the relationship between the primary combustion air and the fuel, or air-fuel ratio. The minimum temperature in the combustion chamber 8 is established by the heat removal in the turbulent layer 2 and the aforementioned primary air-fuel relationship or ratio in the turbulent layer 2. As a result of the interchangeability of the pipe bundle 15, the combustion relationship and heat development of different materials can be taken into account.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A method for burning materials having components that are difficult to burn out and which tend to be adhesive upon heating, comprising the steps of: forming a turbulent layer; connecting said turbulent layer with a combustion chamber; burning said materials in said turbulent layer and said combustion chamber; distributing combustion air to said turbulent layer and said combustion chamber for removing a portion of heat that is released, so that said combustion chamber retains a minimum temperature above a predetermined level, said combustion chamber having said minimum temperature for complete burning therein of combustible gases and vapors, said minimum temperature being controlled by distribution of said combustion air dependent on the heat balance of the gross composition and calorific values of the materials to be burned, residual combustion air being fed into said turbulent layer, heat being removed from said layer through radiating surfaces having dimensions dependent on the composition of fuel and on the proportion of total combustion air initially supplied to said layer, said materials being converted to a combustible state in a primary stage by applying heat obtained from incomplete combustion of the materials in said turbulent layer which produces combustible gases and vapors burned in said combustion chamber.

2. An arrangement for burning materials having components that are difficult to burn out and which tend to be adhesive upon heating, comprising: a turbulent layer; a combustion chamber connected to said turbulent layer; said materials being burned in said turbulent layer and said combustion chamber; means for distributing combustion air to said turbulent layer and said combustion chamber for removing a portion of heat that is released so that said combustion chamber retains a minimum temperature above a predetermined level; a steady-flow chamber connected to said turbulent layer and communicating with said combustion chamber; constricting collar means between said steady-flow chamber and said combustion chamber and having nozzle means for applying combustion air, said combustion chamber having said minimum temperature for complete burning therein of combustible gases and vapors, said minimum temperature being controlled by distribution of said combustion air dependent on the heat balance of the gross composition and calorific values of the materials to be burned, residual combustion air being fed into said turbulent layer, heat being removed from said layer through radiating surfaces having dimensions dependent on the composition of fuel and on the proportion of total combustion air initially supplied to said layer, said materials being converted to a combustible state in a primary stage by applying heat obtained from incomplete combustion of the materials in said turbulent layer which produces combustible gases and vapors burned in said combustion chamber.

3. An arrangement as defined in claim 2, including cooling surface means in said turbulent layer.

4. An arrangement as defined in claim 3, wherein said cooling surface means comprises withdrawable pipe means.

5. An arrangement as defined in claim 2, wherein said combustion chamber has cooling surface means.

6. An arrangement as defined in claim 2, wherein said combustion chamber is fire-tight.

7. An arrangement as defined in claim 2, including a waste heat boiler connected to said combustion chamber through a fire-tight pipe line.

* * * * *